US008167741B1

(12) United States Patent
Murken

(10) Patent No.: US 8,167,741 B1
(45) Date of Patent: May 1, 2012

(54) GOLF TEE EXTENDER

(76) Inventor: Roger E. Murken, Claremont, CA (US)

( * ) Notice: Subject to any disclaimer, the term of this patent is extended or adjusted under 35 U.S.C. 154(b) by 0 days.

(21) Appl. No.: 13/223,606

(22) Filed: Sep. 1, 2011

(51) Int. Cl.
*A63B 57/00* (2006.01)

(52) U.S. Cl. ..... 473/387; 473/400; 473/401

(58) Field of Classification Search ..... 473/387–403; D21/717, 718
See application file for complete search history.

(56) References Cited

U.S. PATENT DOCUMENTS

| | | | | | |
|---|---|---|---|---|---|
| 638,920 | A * | 12/1899 | Grant | 473/396 |
| 1,670,123 | A * | 5/1928 | Ranseen | 473/396 |
| 2,033,269 | A * | 3/1936 | Williams | 473/257 |
| 3,473,812 | A * | 10/1969 | Pelzmann | 473/278 |
| 3,606,344 | A * | 9/1971 | Ball | 473/398 |
| 3,633,919 | A * | 1/1972 | Liccardello | 473/386 |
| D232,568 | S * | 8/1974 | Brown | D21/717 |
| 4,336,940 | A * | 6/1982 | Sprague | 473/393 |
| 5,240,254 | A * | 8/1993 | Adlam | 473/257 |
| 5,413,348 | A * | 5/1995 | Basso | 473/393 |
| 5,437,448 | A * | 8/1995 | Balson | 473/257 |
| 6,494,796 | B2 * | 12/2002 | Echaves | 473/393 |
| 6,679,793 | B2 * | 1/2004 | Joo | 473/393 |
| 6,849,008 | B1 * | 2/2005 | Wang | 473/401 |
| 7,090,594 | B2 * | 8/2006 | Kawashima et al. | 473/396 |
| 7,828,677 | B2 | 11/2010 | Steinhobel | |
| 2005/0003907 | A1 * | 1/2005 | Ijiri | 473/387 |
| 2005/0070378 | A1 * | 3/2005 | Parks et al. | 473/387 |
| 2008/0167143 | A1 * | 7/2008 | Werner | 473/401 |
| 2008/0182684 | A1 | 7/2008 | Carroll | |
| 2010/0179003 | A1 | 7/2010 | Steinhobel | |

* cited by examiner

*Primary Examiner* — Steven Wong
(74) *Attorney, Agent, or Firm* — John K. Park; Park Law Firm

(57) ABSTRACT

This invention relates to a golf tee extender of a simple but effective structure for repetitive tee shots that does not require re-inserting a new tee into the ground. The golf tee extender for repetitive tee shots comprises a ball support portion for receiving a golf ball thereon, an upper opening for allowing insertion of a golf tee, a hollow body for allowing passage of the golf tee, and a tee head chamber for engaging head of the golf tee therein and securely confining and holding head of the golf tee. The tee head chamber is configured in a shape reverse to the shape of the head of the golf tee to securely engage and confine the head of the golf tee. The tee head chamber comprises a middle opening and a lower opening wherein the middle opening is smaller in diameter than the head of the golf tee.

4 Claims, 6 Drawing Sheets

GOLF TEE EXTENDER

BACKGROUND OF THE INVENTION

The present invention relates to a golf tee extender for repetitive tee shots without the need for re-inserting a new tee to the ground comprising: a ball support portion for receiving a golf ball thereon and allowing insertion of a regular golf tee through its opening; a hollow body for allowing passage of the golf tee; and a tee head chamber for engaging the head of the golf tee therein and securely confining and holding the head of the golf tee.

Golfers go to either a golf course or a driving range for practice in order to improve. Most driving ranges nowadays use mats to keep maintenance costs low, but many still grow real grass for practice. To practice, a golfer has to bring a large quantity of tees because wood or plastic tees frequently break or become lost when struck by the head of a golf club. When a tee is broken, the broken lower portion of the golf tee is still left in the ground. Therefore, the broken lower portion needs be removed and another new golf tee inserted into the ground. In addition when the tees are lost during an extended practice, a player has to repeatedly reinsert tees into the ground.

Therefore, it is very troublesome to repetitively insert new tees and to take out and remove the broken lower portions of the golf tees.

In order to prevent this repetitive re-insertion or loss of golf tees, a number of golf tee anchoring devices have been developed. These devices usually have a golf ball support part, an anchoring part, and sometimes a connector connecting the golf ball support part to the anchoring part, with or without a tethering arrangement.

However, these systems generally have all or some of the following disadvantages: tee is still susceptible to tee breakage or a tee is lifted out of the ground; tee system may require a user to reseat or readjust the golf ball support part; system may have many elements of a complex structure, resulting in increased manufacturing costs; and especially when a tether is used, the golfer still must go to the tee system to reseat the dislodged golf ball support part or readjust the tee.

Accordingly, a need for a golf tee extender of a simple but effective structure for repetitive tee shots without the need for re-inserting a new tee into the ground has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a golf tee extender of a simple but effective structure for repetitive tee shots that does not require re-inserting a new tee into the ground. The golf tee extender is made of a flexible and elastomeric material and comprises a hollow cylindrical part for allowing passage of a regular golf tee and a tee head chamber to securely hold the tee. When the golf tee extender with a regular golf tee mounted is inserted into the ground, the rigid golf tee is inserted to below ground level and only the flexible golf tee extender is above the ground. Thus, the golf tee extender allows repetitive shots without the need to reinsert a golf tee on the practice range and produces a longer ball flight because the entire above ground portion is a flexible, hollow tube.

Another object of the invention is to provide a golf tee extender with a simple structure but effective structure for repetitive tee shots that does not require re-inserting a new tee to the ground. The golf tee extender device can be used with any length of a wood or plastic tee commercially available in lengths from 2⅛" to 4", complying with USGA specifications for an authorized golf tee. The USGA rule 11.1 states that a tee is to be no longer than 4 inches, and the length of the golf tee extender device can be modified by using a different length of a rigid tee and/or by trimming the flexible tubular ball support.

Yet another object of the invention is to provide a golf tee extender for repetitive tee shots that does not require re-inserting a new tee into the ground comprising: a ball support portion for receiving a golf ball thereon and allowing insertion of a regular golf tee through its opening; a hollow body for allowing passage of the golf tee; and a tee head chamber for engaging head of the golf tee therein and securely confining and holding the head of the golf tee. The tee head chamber is configured in a shape reverse to the shape of the head of the golf tee to securely engage and confine the head of the golf tee. Additionally, the tee head chamber comprises a middle opening and a lower opening wherein the diameter of the middle opening is smaller than the diameter of head of the golf tee. The golf tee extender may further comprise a recess between the hollow body and the tee head chamber in order to make insertion of the golf tee extender into the ground easier. The hollow body may be trimmed to adjust the height of the golf tee extender to suit various height needs.

Another aspect of the invention provides a golf tee extender for repetitive tee shots comprising: a ball support portion, comprising a rim to define a golf ball engaging surface for receiving a golf ball thereon and an upper opening for allowing insertion of a golf tee; a hollow body for allowing passage of the golf tee; and a tee head chamber for engaging the head of the golf tee therein and securely confining and holding the head of the golf tee; wherein the tee head chamber is configured in a shape reverse to the shape of the head of the golf tee to securely engage and confine the head of the golf tee; wherein the tee head chamber comprises a breakable membrane and a lower opening wherein the breakable membrane initially seals upper part of the tee head chamber and is broken when the golf tee is inserted within the tee head chamber.

Another aspect of the invention provides the golf tee extender to be made of two different materials for the upper and lower portions, unique to this invention. The upper portion made of more flexible and soft material and the lower portion made of less flexible and less soft material to help the tee insertion into the ground.

The advantages of the present invention are: (1) the golf tee extender is for repetitive tee shots that does not require re-inserting a new tee to the ground; (2) a golf tee extender has a simple structure, but is effective for producing maximum anchoring to inhibit or prohibit dislodgement; (3) the golf tee extender increases the energy transfer from a swinging golf club to a golf ball resulting in an increase in the distance traveled by the golf ball struck; (4) the golf tee extender's recess helps insertion of the golf tee extender to the ground easier; and (5) the different materials used for the upper and lower parts leave the portion coming to contact with the golf club soft and flexible, but the portion coming to contact with the ground to be stiffer and more penetrating (and also more securely grip the head of a tee).

Although the present invention is briefly summarized, the fuller understanding of the invention can be obtained by the following drawings, detailed description, and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1A:
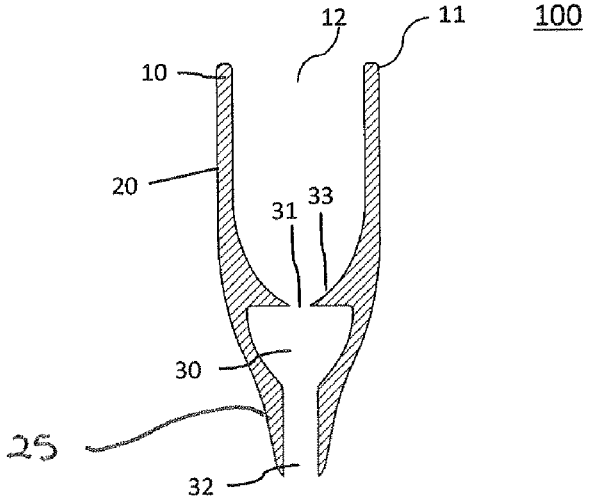
FIG. 1(*a*)-(*c*) is a cross-sectional view of the golf tee extender device identified as GTED No. 1.
Figure 1B:
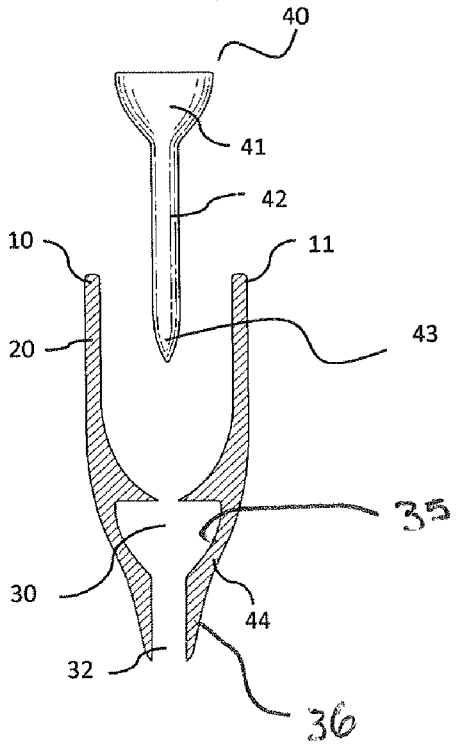
Figure 1C:
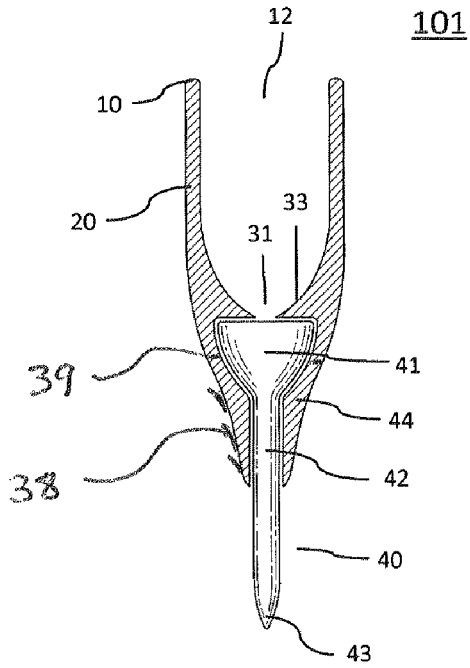

FIG. 1(*a*)-(*c*) shows the golf tee extender 100, identified as GTED No. 1, for repetitive tee shots that does not require re-inserting new tees to the ground. A regular or standard golf tee is inserted into and securely mounted into the golf tee extender 100. The golf tee extender 100 for repetitive tee shots comprises a ball support portion 10 for receiving a golf ball thereon. The ball support portion has an upper hollow section 20 and a lower hollow section 25.

The upper hollow section 20 is the upper portion of the golf ball tee 100, and it has an upper opening 12 at one end and a tee pass-through hole 31 at the opposite end. The upper hollow section 20 has a ball support portion 10 ending at the upper opening 12, wherein the edges of the upper opening 12 defines the ball engaging surface 11 where a golf ball is placed for hitting.

The golf tee 40 then can be inserted into the ball support portion 10 through the upper hollow section 20 via the upper opening 12, and through the tee pass-through hole 31 to be securely captured in the lower hollow section 25 at the tee head chamber 30.

The tee head chamber 30 is configured in a shape substantially reverse to the shape of the head 41 of the golf tee 40 to securely engage and confine the head 41 of the golf tee 40. As shown on the FIG. 1(*a*), the tee head chamber 30 communicates with the upper hollow section 20 via the tee pass-through hole 31 and ends at a lower opening 32. The diameter of the tee pass-through hole 31 is substantially smaller than the diameter of the head of the golf tee 41.

The tee head chamber 30 is designed to securely hold the golf tee head, but may enclose both of the head and a portion of the stem 42 of the golf tee. The separation of the golf tee extender 100 from the golf tee is made difficult because the tubular portion surrounding the head and stem of the golf tee is stretchable and its internal measurements are designed to be identical or nominally smaller than the head 41 and stem 42 of the golf tee, thereby compressing the rigid golf tee 40 once the golf tee has been inserted into the golf tee extender 100.

The golf tee extender 100 is constructed of an elastic, resilient material, such as elastomer, rubber, or plastic whether natural or synthetic, to prevent any tee breakage or dislodgement caused by the impact of a golf club head thereagainst. The material is durable to withstand repeated strikes by a club head. Besides, the rim of the ball support portion may be slightly greater in diameter than the head of the golf tee so as to produce a more stable base to support a golf ball thereon.

The hollow body 20 is tubular or cylindrical or various other tubular shapes for the passage of the golf tee 40 and the tee head chamber 30 is stretchable so as to allow the passage of the golf tee 40 and especially, its tee head 41, and securely confine and hold the golf tee head 41. The stem section 44 extends downward below the head of the golf tee 41 to firmly compress and hold the stem of the golf tee 42. Specifically, the elastic middle opening rim 33 of the tee head chamber 30 stretches to allow the passage of the golf tee 40, but once the golf tee head 41 is mounted within the tee head chamber 30, the middle opening rim 33 does not allow upward slippage of the golf tee head 41, thereby securely holding the golf tee head 41.

While tee head chamber 30 engages, surrounds and confines the head and shaft of the rigid tee 40, the diameter of the inner wall 21 of the upper hollow section 20 may be made smaller than the head and stem of the rigid tee which requires that the golf tee extender 100 be stretched to allow passage of the rigid tee 40 through the internal tee head chamber 30 designed to hold the head and shaft of the rigid tee. The pressure applied by the golf tee extender 100 to the head and shaft of the golf tee results from the stretchable internal chamber compressing onto the head and shaft of the rigid tee.

The tee head chamber 30 and the stem section 44 may contain an adhesive therein to tightly bond the tee head chamber 30 and the stem of the golf tee 40. Alternatively, the adhesive may be applied separately when placing the golf tee 40 into the tee head chamber 30.

Moreover the tee head chamber 30 has an internal wall 35, wherein the diameter of the area formed by the internal wall 30 near the tee pass-through hole 31 is gradually reduced by the narrowing of the area formed by the internal wall 35 towards the lower opening 32. Alternately, the tee head chamber 30 may have an elongated section 36 wherein the diameter of internal wall 35 remains substantially constant throughout the elongated section 36. Additionally, the diameter of the lower opening 32 may be either identical to or nominally less than the diameter of the stem 42 of the tee 40, thereby compressing and securely tightening the golf tee 40.

Figure 2:
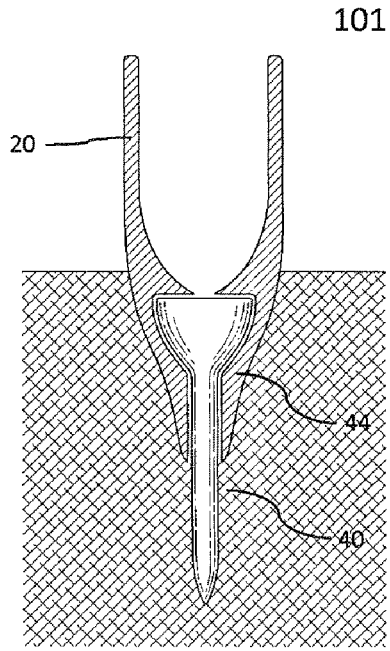
FIG. 2 is a cross-sectional view of the golf tee extender device as it is meant to be used with the entire rigid tee below the ground level.

FIG. 2 shows the golf tee extender device inserted into the ground as designed with the entire stem 42 and either partial or complete head 41 of the golf tee 40 into the ground. One of the advantages of this invention is that the ball support portion 10 may be comprises of two different materials for the upper hollow portion 20 and the lower hollow portion 25, wherein the material used for the lower hollow portion 25 is stiffer than the material used for the upper hollow portion 20 enabling the lower hollow portion 25 to penetrate the ground more conveniently than the less softer material used for the upper hollow portion 20. The lower hollow portion 25 made be made of stiffer rubber or even harder material, such as plastic, fiber, or metal. Moreover, the outer surface of the lower hollow section may have a roughed surface 38, such as and not limited to being ribbed, corrugated, protruding surfaces, or needles extending out surfaces similar to that of a porcupine, to help prevent the golf tee extender from easily pulling out of the ground.

The flexible tube of the golf tee extender device 101 bends when hit by a golf club and then returns to its pre-hit configuration, standing straight up, after the strike without any additional support, either inside or outside the upper hollow section, other than the tee 40 inserted into the ball support portion. Meanwhile, the rigid tee of the golf tee extender device is firmly anchored in the ground and the golf tee extender device 101 is not broken or dislodged.

The golf tee extender device 100, 101 is inserted into the ground until the head of the golf tee is at or below the ground level, and only the flexible tubular portion of the upper hollow section 20 extends above ground. Thus, entire above ground portion is a flexible tubular golf tee extender 100, and when hit by a golf club, the fulcrum point of bending may be at ground level or lower, unlike all other known prior art. Moreover, unlike any other prior art, because this invention may be made with two different materials for the upper hollow section 20 and the lower hollow section 25, the upper and more necessarily flexible portion of the upper hollow section 20 may be made of highly flexible material contrast to the lower and more necessarily stiff portion of the lower hollow section 25 may be made of more stiffer material, all helping to give greater resistance to the golf tee extender 100 being pulled off the ground and to result in greater kinetic energy transferred to the golf ball enabling a longer flight of the golf ball. Although the transition point 39 between two materials may be at or near the level of the tee pass-through hole 31, it is believed to be the best if the transition point 39 between two materials is slightly below the level of the tee pass-through hole 31.

Moreover although the two materials used may be sharply divided by the transition point 39 such that the material changes over the transition point 39 abruptly, it would be better if the two materials would gradually change stiffness over a transition area about the transition point 39 somewhat below the level of the tee pass-through hole 31. This smooth and gradual change of stiffness may be best achieved by using elastomeric materials, such as rubber. Although the words "two materials" are used, but the term "two materials" is to be understood broadly to specifically include one type of material (such as rubber) with two different stiffness or flexibility due to their difference in content, texture, consistency, roughness, or other internal (such as the use of different alloys or impregnating with greater impurities) or external differences (such as the use of different coatings or ribbings). For example, a same rubber material may be used for "two materials," only differed by each having different elasticity or flexibility or texture. The invention shall not be interpreted as limiting to the use of two totally different materials, such as rubber and metal.

Figure 3:
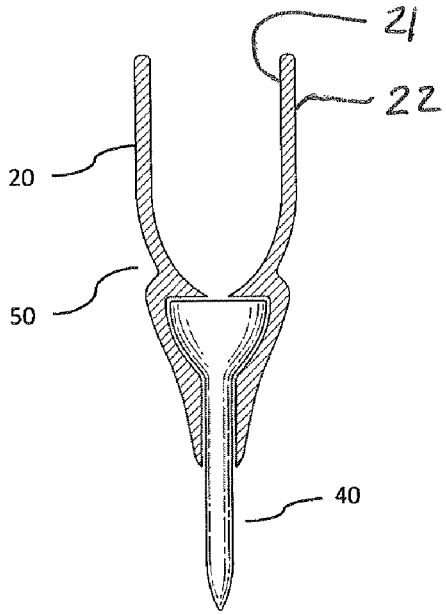
FIG. 3 is a cross-sectional view of another embodiment of the golf tee extender device.

FIG. 3 shows another embodiment of the golf tee extender 100. The golf tee extender device further comprises a recess 50 between the hollow body 20 and the tee head chamber 30 to facilitate the insertion of the golf tee 40 into the ground. A user holds the recessed part 50 and pushes the golf tee 40 into the ground. The hollow body 20 tapers downward and then expands to form the base of a cone. The cone, then, tapers downward again. The base of the cone forms an angle of less than 90 degrees with the portion of the hollow body 20 right above the base of the cone. The cone configuration deflects the ground away from and protects the flexible tube. This further inhibits or prohibits upwards displacement of the golf tee extender when hit by a golf club.

Also, FIG. 3 shows an inner wall 21 and an outer wall 22 of the upper hollow section, such that the diameter of the area formed by the inner wall 21 near the upper opening 12 is gradually reduced by the narrowing of the area formed by the inner wall 21 towards the tee pass-through hole. This gradual narrowing of the diameter of the circumference created by the inner wall 21 may be throughout the entire length of the upper hollow section, about half, about lower one third, or any portion thereof.

Figure 4:
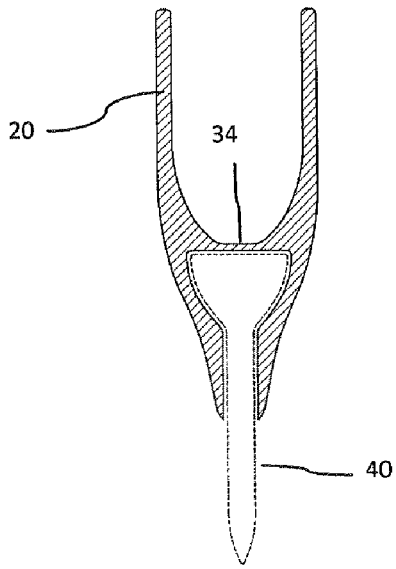
FIG. 4 is a cross-sectional view of yet another embodiment of the golf tee extender device.

FIG. 4 shows an alternative embodiment of the golf tee extender device 100. Here, the middle opening 31 is initially sealed by a breakable membrane 34. When the golf tee 40 is inserted into the tee head chamber 30, the golf tee tip 43 breaks the breakable membrane 34, making the middle opening 31. The breakable membrane 34 is thinner than the middle opening rim 33.

Figure 5:
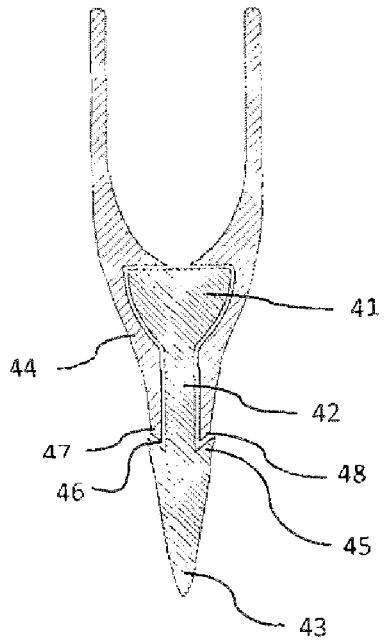
FIG. 5 is a cross-sectional view of another embodiment of the modified rigid golf tee extender identified as GTED No. 2.

FIG. 5 shows another alternative embodiment of the golf tee extender device 101 identified as GTED NO. 2. Here, the golf tee 40 is modified by using a wood or plastic golf tee which has a stem 42 in the shape of a cone and profile shape of an arrowhead on the lower stem 42 and tip 43 of the rigid tee. The arrowhead's base 45 extends outwards and upwards toward the head 41 of the golf tee producing an angle 46 of less than 90 degrees with the stem line and an angle opening which projects toward the head 41 of the golf tee.

The stem section 44 of the flexible tube extends below the head of the golf tee until it reaches the base 45 of the cone shaped distal stem. The distal portion of the tapered flexible tube is cut sharply at an angle 47 identical to the angle 46 in the arrowhead section of the rigid tee.

The modified golf tee extender (flexible tubular portion) is fitted into the notch created by the circumferential, arrowhead, cone-like configuration at the distal end of the golf tee stem. The contact plane 48 between the flexible tubular portion and the rigid tee extends upwards and outwards. As the modified GTED is inserted into the ground, the cone-like arrowhead configuration of the distal rigid golf tee deflects the ground away from and protect the distal end of the flexible tubular portion from direct pressure thereby inhibits its upward displacement as the modified golf tee extender is inserted into the ground.

Figure 6:
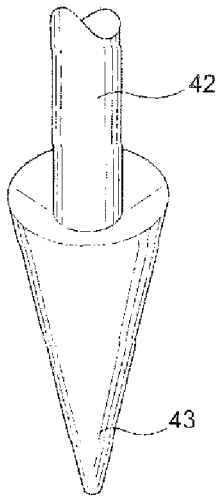
FIG. 6 is a three dimensional view of the stem tip of the rigid golf tee used in FIG. 5.

FIG. 6 shows a three dimensional perspective view of the modified rigid tee used in FIG. 5. The lower stem 42 and tip 43 of the rigid tee are transformed into a cone configuration shown in this drawing with an arrowhead profile best shown in FIG. 5.

Figure 7:
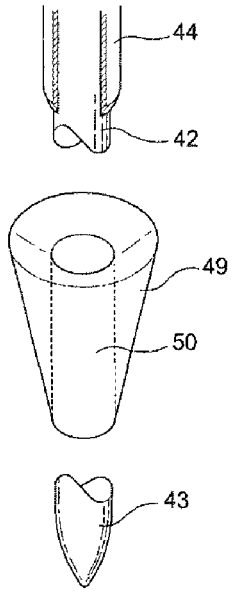
FIG. 7 is a three dimensional view of a cone which can be used with a regular tee to produce the modified rigid golf tee extender in FIG. 5.

FIG. 7 shows a wood or plastic cone which can be used with a regular golf tee to produce the rigid tee with a cone tip shown in FIG. 5. The cone 49 has an internal hollow cylinder 50 which can be slipped over the tip 43 of a regular wood or plastic tee and advanced up the stem 42 to a desired level and then bonded to the stem of the golf tee with an adhesive.

Figure 8:
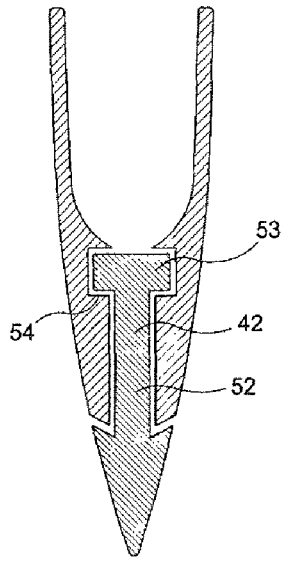
FIG. 8 is a cross-sectional view of still another embodiment of a modified golf tee extender identified as a GTED No. 3.

FIG. 8 shows another alternative embodiment of the golf tee extender device identified as GTED No. 3 in cross-sectional profile. The GTED No. 3 is the same as the GTED No. 2 except for the head 53 of the golf tee. The head of the golf tee is shaped like a pill box with square edges. There is no tapering of the rigid golf tee head towards the stem 42. A notch configuration 54 is created between the inferior surface of the pill box shaped head of the golf tee and the stem. This sharp notch inhibits upward slippage of the flexible tube when it is struck by a swinging golf club.

Figure 9:
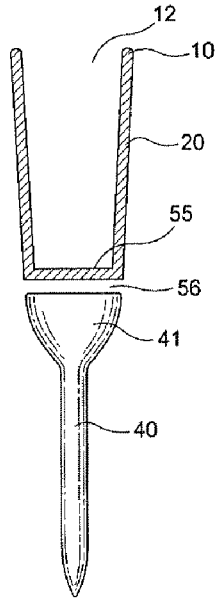
FIG. 9 is a cross-sectional view of another embodiment of a modified golf tee extender identified as GTED No. 4.

FIG. 9 shows another alternative embodiment of the golf tee extender device identified as GTED No. 4 in cross-sectional profile. A regular rigid wood or plastic golf tee 40 or a similar golf tee is used having different measurements (diameters of the golf tee head and length of stem). Using a rigid golf tee with the same configuration but different measurements would require the rigid tee be separately manufactured out of wood or molded to form a rigid plastic tee.

The flexible portion of the GTED No. 4 is made out of an elastic resilient material such as elastomer, rubber, or plastic to prevent tee breakage or dislodgement when struck by a swinging golf club. The flexible portion consists of a hollow body 20 with a ball support portion 10 for receiving a golf ball thereon and an upper opening 12. The opening 12 is larger than the head of the golf tee 41. The hollow body 20 tapers as it descends to approach the head 41 of the golf tee.

The lower hollow body of the flexible portion ends as a blind end forming the base of the flexible portion of the GTED No. 4 now shaped similar to a common garden pot.

The flexible portion is bonded to the rigid tee with an adhesive 56 placed between the base of the flexible portion and the superior surface of the head 41 of the golf tee.

Figure 10:
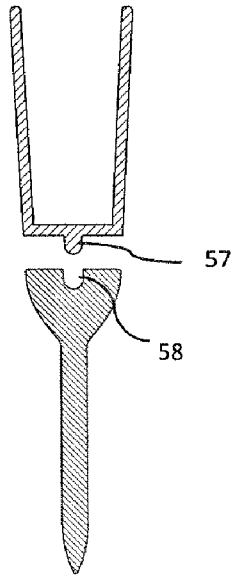
FIG. 10 is a cross-sectional view of still another embodiment of a modified golf tee extender in FIG. 9.

FIG. 10 is a cross-sectional view of still another embodiment of a modified golf tee extender in FIG. 9. The male protrusion 57 of the GTED No. 4 fits into the female portion 58 of the golf tee for tight attachment of the GTED to the golf tee.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. Golf tee extender for repetitive tee shots comprising:

a ball support portion having an upper hollowed section having an upper opening and a tee pass-through hole, wherein the upper opening forms a ball engaging surface for receiving a ball thereon, and wherein the upper opening and the tee pass-through hole are used for inserting a tee with a head and a stem through;

a ball support section additionally has a lower hollow section with a lower opening forming a tee head chamber, wherein the lower opening is substantially smaller in size than the diameter of the head of the tee, wherein the shape of the tee head chamber is substantially reverse of the shape of the head of the tee enabling the tee head chamber to firmly engage the head of the tee therein, and wherein the lower opening allowing the stem of the tee to pass through; and wherein the material used for the lower hollow portion is stiffer than the material used for the upper hollow portion enabling the lower hollow portion to penetrate the ground more conveniently than the less softer material used for the upper hollow portion, wherein the golf tee extender is constructed of a resilient material for preventing any breakage due to the impact of a golf club head thereagainst and for enabling the extender to support the weight of the ball without any additional support to the upper hollow portion except for the tee inserted in and through the tee pass-through hole, and wherein the two materials used for different flexibility changes gradually over a transition area about a transition point.

2. Golf tee extender of claim 1, wherein the resilient material is elastomeric for both the upper hollow portion and the lower hollow portion.

3. Golf tee extender of claim 1, wherein the resilient material used for the lower hollow portion is non-elastomeric.

4. Golf tee extender of claim 1, wherein the tee head chamber has an internal wall, wherein the diameter of the area formed by a internal wall near the tee pass-through hole is gradually reduced by the narrowing of the area formed by the internal wall towards the lower opening.

* * * * *